US011523478B2

(12) United States Patent
Yu et al.

(10) Patent No.: US 11,523,478 B2
(45) Date of Patent: Dec. 6, 2022

(54) FLEXIBLE DIMMING CIRCUIT AND A METHOD THEREOF

(71) Applicant: Chengdu Monolithic Power Systems Co., Ltd., Chengdu (CN)

(72) Inventors: Bo Yu, Chengdu (CN); Bairen Liu, Chengdu (CN); Junxin Tan, Chengdu (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 279 days.

(21) Appl. No.: 16/891,271

(22) Filed: Jun. 3, 2020

(65) Prior Publication Data

US 2020/0389953 A1 Dec. 10, 2020

(30) Foreign Application Priority Data

Jun. 6, 2019 (CN) ..... 201910491568.0

(51) Int. Cl.

*H05B 45/30* (2020.01)
*H05B 45/14* (2020.01)
*H05B 45/305* (2020.01)
*H05B 45/335* (2020.01)

(52) U.S. Cl.

CPC ..... *H05B 45/14* (2020.01); *H05B 45/305* (2020.01); *H05B 45/335* (2020.01)

(58) Field of Classification Search

CPC .. H05B 43/305; H05B 45/325; H05B 45/335; H05B 45/375; H05B 45/395; H05B 45/3725

See application file for complete search history.

(56) References Cited

U.S. PATENT DOCUMENTS

| | | | | |
|---|---|---|---|---|
| 8,604,710 | B2 | 12/2013 | Yu et al. | |
| 9,351,351 | B2 * | 5/2016 | Pereira | H05B 45/382 |
| 9,408,272 | B2 | 8/2016 | Lian | |
| 9,717,123 | B1 * | 7/2017 | Yao | H05B 45/10 |
| 10,707,763 | B1 * | 7/2020 | Xiong | H05B 45/39 |
| 2011/0109238 | A1 * | 5/2011 | Tang | H05B 45/46 315/250 |
| 2012/0274877 | A1 * | 11/2012 | Sasaki | H05B 45/3725 315/186 |
| 2012/0286686 | A1 * | 11/2012 | Watanabe | H05B 45/3725 315/226 |
| 2015/0084544 | A1 * | 3/2015 | Mitterbacher | H05B 45/3725 315/294 |
| 2018/0178710 | A1 * | 6/2018 | Ichikawa | H05B 45/48 |
| 2019/0159310 | A1 * | 5/2019 | Yang | H05B 45/10 |

* cited by examiner

*Primary Examiner* — Tung X Le
(74) *Attorney, Agent, or Firm* — Perkins Coie LLP

(57) ABSTRACT

A dimming circuit for dimming a current flowing through a light emitting device, having: a multi-function pin, configured to receive a dimming signal; wherein when the dimming signal is an analog voltage signal, an amplitude of the current flowing through the light emitting device is regulated based on the dimming signal; when the dimming signal is a pulse signal and a frequency of the dimming signal is in a first frequency range, a duty cycle of the current flowing through the light emitting device is regulated based on the dimming signal; and when the dimming signal is the pulse signal and the frequency of the dimming signal is in a second frequency range, the amplitude of the current flowing through the light emitting device is regulated based on the dimming signal.

19 Claims, 5 Drawing Sheets

FLEXIBLE DIMMING CIRCUIT AND A METHOD THEREOF

CROSS-REFERENCE TO RELATED APPLICATIONS

This application claims priority to and the benefit of Chinese Patent Application No. 201910491568.0, filed on Jun. 6, 2019, which is incorporated herein by reference in its entirety.

FIELD

The present invention relates generally to electronic circuits, and more particularly but not exclusively to a dimming circuit of a light emitting device and a method thereof.

BACKGROUND

To meet the different brightness requirements of different applications, light emitting device dimming is necessary. The brightness of a LED (Light-emitting Diode), which is a widely adopted light emitting device today, depends on an average current flowing through the LED. That is to say, LED dimming could be realized by regulating the average current flowing through the LED. Currently, two techniques of regulating the average current flowing through the LED are popular, one is regulating an amplitude of the current flowing through the LED, and the other one is regulating a duty cycle of the current flowing through the LED.

In real applications, different dimming signals could be combined to realize LED dimming. However, multiple dimming signals may increase the complexity of a dimming circuit, and will need multiple dimming pins to receive the multiple dimming signals, which increase the size and cost of the dimming circuit.

SUMMARY

It is an object of the present invention to provide a dimming chip with simple structure and a multi-function pin to process the dimming signal in multiple forms.

In accomplishing the above and other objects, there has been provided, in accordance with an embodiment of the present invention, a dimming circuit for dimming a current flowing through a light emitting device, comprising: a multi-function pin, configured to receive a dimming signal; wherein when the dimming signal is an analog voltage signal, an amplitude of the current flowing through the light emitting device is regulated based on the dimming signal; when the dimming signal is a pulse signal and a frequency of the dimming signal is in a first frequency range, a duty cycle of the current flowing through the light emitting device is regulated based on the dimming signal; and when the dimming signal is the pulse signal and the frequency of the dimming signal is in a second frequency range, the amplitude of the current flowing through the light emitting device is regulated based on the dimming signal.

In accomplishing the above and other objects, there has been provided, in accordance with an embodiment of the present invention, a control method of a dimming circuit adopted to control a dimming switch coupled in series with a light emitting device, comprising: receiving and detecting a dimming signal; regulating an amplitude of a current flowing through the light emitting device based on the dimming signal when the dimming signal is an analog voltage signal; detecting a frequency of the dimming signal when the dimming signal is a pulse signal; regulating a duty cycle of the current flowing through the light emitting device based on the dimming signal when the frequency of the dimming signal is in a first frequency range; and regulating the amplitude of the current flowing through the light emitting device based on the dimming signal when the frequency of the dimming signal is in a second frequency range.

In accomplishing the above and other objects, there has been provided, in accordance with an embodiment of the present invention, a control method of a dimming circuit adopted to control a dimming switch coupled in series with a light emitting device, comprising: receiving a dimming signal; dividing the dimming signal into a first frequency dimming signal and a second frequency dimming signal; regulating a duty cycle of the current flowing through the light emitting device based on the first frequency dimming signal; and regulating an amplitude of the current flowing through the light emitting device based on the second frequency dimming signal.

The use of the same reference label in different drawings indicates the same or like components.

DETAILED DESCRIPTION

In the present invention, numerous specific details are provided, such as examples of circuits, components, and methods, to provide a thorough understanding of embodiments of the invention. Persons of ordinary skill in the art would recognize, however, that the invention can be practiced without one or more of the specific details. In other instances, well-known details are not shown or described to avoid obscuring aspects of the invention.

Figure 1:
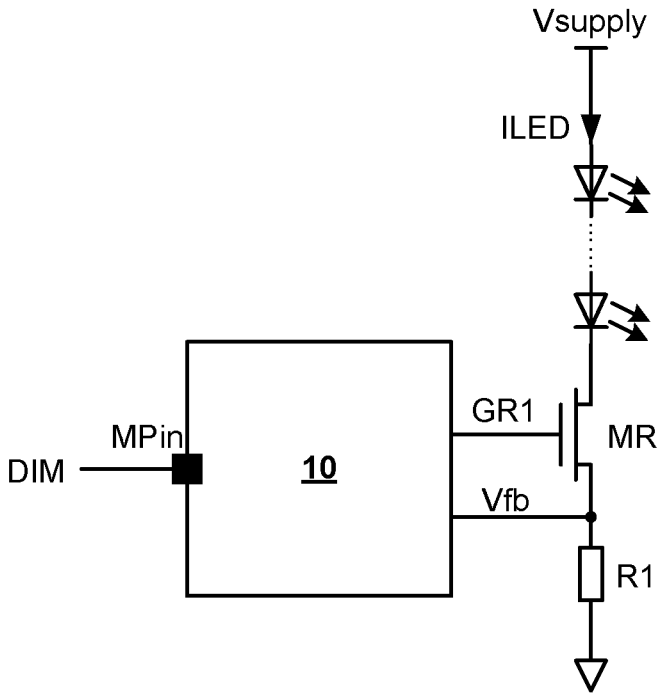
FIG. 1 schematically shows a dimming circuit 10 and an application example of the dimming circuit 10 in accordance with an embodiment of the present invention.

FIG. 1 schematically shows a dimming circuit 10 and an application example of the dimming circuit 10 in accordance with an embodiment of the present invention. In the example of FIG. 1, the dimming circuit 10 is adopted to regulate a current flowing through a LED string comprising a plurality of LEDs coupled in series. The dimming circuit 10 could be integrated to a chip with a multi-function pin MPin receiving a dimming signal DIM. The dimming circuit 10 provides a switching control signal GR1 to control a dimming switch MR based on the dimming signal DIM. The dimming signal DIM may be an analog signal or may be a pulse signal, or may be in other forms. In one embodiment, when the dimming signal DIM is an analog signal, an amplitude of the current flowing through the LED string is regulated based on the dimming signal DIM; when the dimming signal DIM is a pulse signal, and meanwhile a frequency of the dimming signal DIM is in a first frequency range, a duty cycle of the current flowing through the LED string is regulated based on the dimming signal DIM; and when the dimming signal DIM is a pulse signal, and meanwhile the frequency of the dimming signal DIM is in a second frequency range, the amplitude of the current flowing through the LED string is regulated based on the dimming signal DIM. The frequency of the dimming signal DIM when in the first frequency range is lower than the frequency of the dimming signal DIM when in the second frequency range.

In the example of FIG. 1, a current ILED flows through the LED string which is powered by a power supply Vsupply. The LED string is coupled in series with the dimming switch MR and a feedback resistor R1. The current ILED following through the LED string also flows through the dimming switch MR and the feedback resistor R1, which means that a feedback voltage Vfb across the feedback resistor R1 indicates the current ILED. The dimming switch MR is controlled by the switching control signal GR1 to regulate the current ILED. The feedback voltage Vfb is fed back to the dimming circuit 10 to participate in the control of the switching control signal GR1. In some embodiments, the dimming switch MR or the feedback resistor R1, or both of the dimming switch MR and the feedback resistor R1, is integrated with the dimming circuit 10 in a single chip.

In one embodiment, when the frequency of the dimming signal DIM is lower than a first frequency threshold F1, the duty cycle of the current ILED flowing through the LED string is regulated; when the frequency of the dimming signal DIM is higher than a second frequency threshold F2, the amplitude of the current ILED flowing through the LED string is regulated; wherein the first frequency threshold F1 is lower than the second frequency threshold F2.

In one embodiment, the first frequency range is corresponding to a frequency between zero and the first frequency threshold F1, and the second frequency range is corresponding to a frequency larger than the second frequency threshold F2.

In one embodiment, when the frequency of the dimming signal DIM is higher than the second frequency threshold F2, the duty cycle of the current ILED flowing through the LED string is regulated; when the frequency of the dimming signal DIM is lower than the first frequency threshold F1, the amplitude of the current ILED flowing through the LED string is regulated. The regulation ways of the current ILED based on the dimming signal DIM could be determined according to the application requirements.

Figure 2:
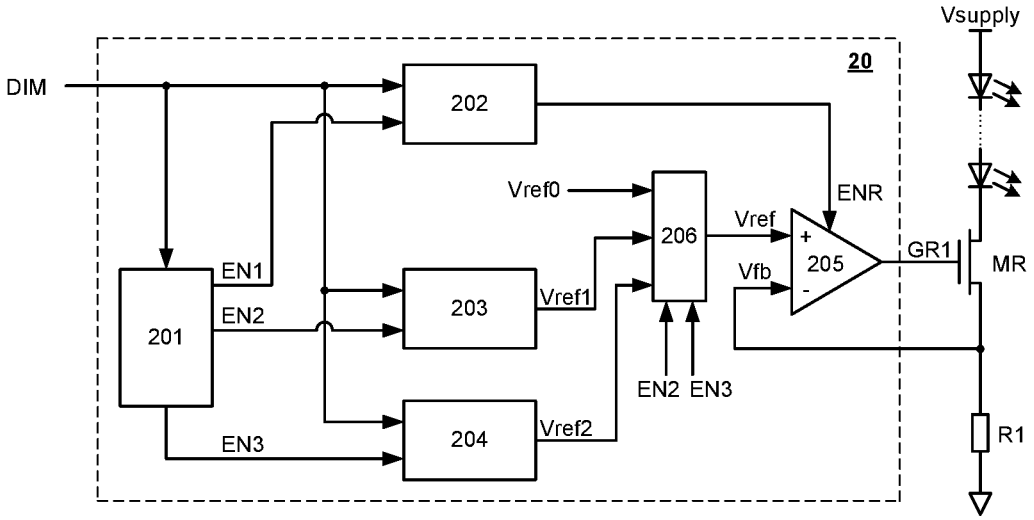
FIG. 2 schematically shows a dimming circuit 20 in accordance with an embodiment of the present invention.

FIG. 2 schematically shows a dimming circuit 20 in accordance with an embodiment of the present invention. As shown in FIG. 2, the dimming circuit 20 comprises: a signal detecting circuit 201, configured to receive the dimming signal DIM, and to provide a duty cycle regulating enable signal EN1, an amplitude regulating enable signal EN2 and an analog voltage regulating enable signal EN3 based on the dimming signal DIM; a duty cycle regulating circuit 202, configured to receive the dimming signal DIM and the duty cycle regulating enable signal EN1, and to provide a duty cycle regulating signal ENR based on the dimming signal DIM and the duty cycle regulating enable signal EN1; an amplitude regulating circuit 203, configured to receive the dimming signal DIM and the amplitude regulating enable signal EN2, and to provide a pulse reference signal Vref1 based on the dimming signal DIM and the amplitude regulating enable signal EN2; an analog regulating circuit 204, configured to receive the dimming signal DIM and the analog voltage regulating enable signal EN3, and to provide an analog reference signal Vref2 based on the dimming signal DIM and the analog voltage regulating enable signal EN3; and an amplifying circuit 205, configured to receive the duty cycle regulating signal ENR, a dimming amplitude reference signal Vref and a feedback voltage Vfb indicating the current ILED flowing through the LED string, wherein the amplifying circuit 205 is enabled by the duty cycle regulating signal ENR, and provides the switching control signal GR1 based on an amplifying result A(GR1) of the dimming amplitude reference signal Vref and the feedback voltage Vfb; wherein the dimming amplitude reference signal Vref is one of a default reference signal Vref0, the pulse reference signal Vref1 and the analog reference signal Vref2. The default reference signal Vref0 could be generated by an in-chip reference generating circuit, or could be provided by an off-chip source.

In one embodiment, the dimming circuit 20 further comprises a selecting circuit 206, configured to receive the default reference signal Vref0, the pulse reference signal Vref1, the analog reference signal Vref2, the amplitude regulating enable signal EN2 and the analog voltage regulating enable signal EN3, wherein the selecting circuit 206 selects the pulse reference signal vref1 as the dimming amplitude reference signal Vref when amplitude regulating enable signal EN2 is valid, and selects the analog reference signal Vref2 as the dimming amplitude reference signal Vref when the analog voltage regulating enable signal EN3 is valid, and selects the default reference signal Vref0 as the dimming amplitude reference signal Vref when neither of the amplitude regulating enable signal EN2 and the analog voltage regulating enable signal EN3 is valid.

In one embodiment, the selecting circuit 206 comprises a logic circuit and a multiplexer switch. The logic circuit performs logic operation to the amplitude regulating enable signal EN2 and the analog voltage regulating enable signal EN3. The multiplexer switch provides one of the default reference signal Vref0, the pulse reference signal Vref1 and the analog reference signal Vref2 as the dimming amplitude reference signal Vref based on the logic operation result.

In one embodiment, the selecting circuit 206 comprises a multiplexer switch. The amplitude regulating enable signal EN2 and the analog voltage regulating enable signal EN3 are provided to the multiplexer switch to control the multiplexer switch, and the multiplexer switch provides one of the default reference signal Vref0, the pulse reference signal Vref1 and the analog reference signal Vref2 as the dimming amplitude reference signal Vref under the control of the amplitude regulating enable signal EN2 and the analog voltage regulating enable signal EN3.

In one embodiment, the duty cycle regulating circuit 202 comprises a frequency converting circuit. When the duty cycle regulating enable signal EN1 is valid, i.e., the dimming signal DIM is a pulse signal and the frequency of the dimming signal DIM is in the first frequency range, the duty cycle regulating signal ENR is generated based on the dimming signal DIM, wherein the duty cycle regulating signal ENR is a pulse signal and may have a different frequency from the dimming signal DIM.

In some embodiments, the duty cycle regulating circuit 202 comprises a switch. When the duty cycle regulating enable signal EN1 is valid, the switch is turned on, and passes the dimming signal DIM to be the duty cycle regulating signal ENR.

In one embodiment, the amplitude regulating circuit 203 comprises a frequency-voltage converting circuit. When the amplitude regulating enable signal EN2 is valid, the dimming signal DIM is converted by the amplitude regulating circuit 203 to the pulse reference signal Vref1. The value of the pulse reference signal Vref1 is in proportional to the frequency of the dimming signal DIM. In some embodiments, the amplitude regulating circuit 203 comprises a filter circuit. In some embodiments, the amplitude regulating circuit 203 comprises a digital-to-analog converting circuit. It should be understood that any circuit could convert a pulse signal to a voltage signal could be adopted to convert the dimming signal DIM to the pulse reference signal vref1.

In one embodiment, the analog regulating circuit 204 comprises a scaling circuit. When the analog voltage regulating enable signal EN3 is valid, i.e., the dimming signal DIM is an analog signal, the dimming signal DIM is converted to the analog reference signal Vref2, wherein the value of the analog reference signal Vref2 is in proportional to the value of the dimming signal DIM. In some embodiments, the value of the analog reference signal Vref2 is equal to the value of the dimming signal DIM.

Figure 3:
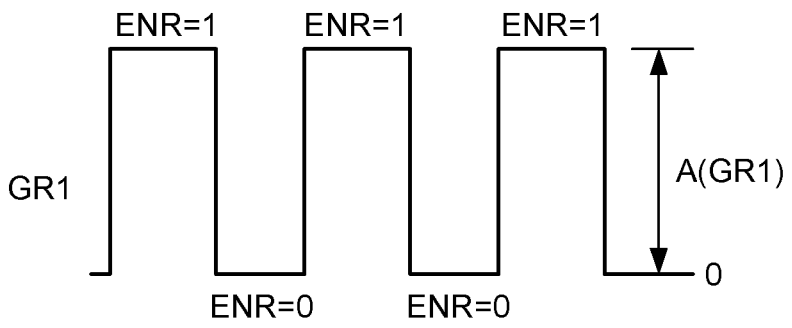
FIG. 3 shows a waveform of the switching control signal GR1 in accordance with an embodiment of the present invention.

FIG. 3 shows a waveform of the switching control signal GR1 in accordance with an embodiment of the present invention. As shown in FIG. 3, the switching control signal GR1 is a pulse signal, and the duty cycle of the switching control signal GR1 is determined by the duty cycle regulating signal ENR. In the example of FIG. 3, when the duty cycle regulating signal ENR is logic 1, the amplifying circuit 205 works, and provides the amplifying result A(GR1), which determines the amplitude of the switching control signal GR1; when the duty cycle regulating signal ENR is logic 0, the amplifying circuit 205 stops working, and the switching control signal GR1 turns to be zero. The amplitude of the switching control signal GR1 determines the conduction degree of the dimming switch MR, which further determines the amplitude of the current ILED.

Figure 4:
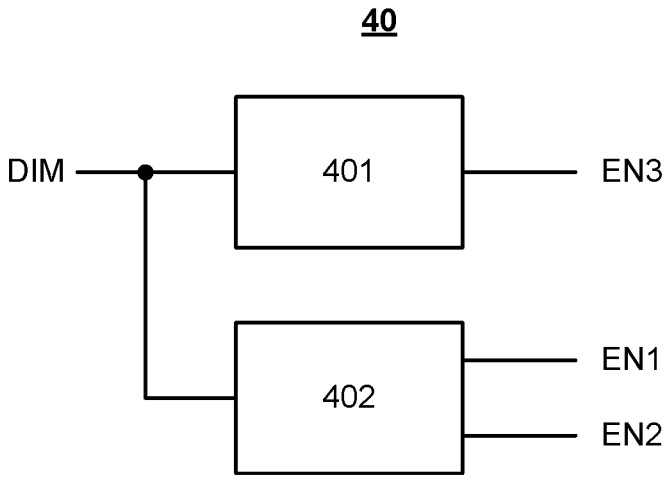
FIG. 4 schematically shows a signal detecting circuit 40 in accordance with an embodiment of the present invention.

FIG. 4 schematically shows a signal detecting circuit 40 in accordance with an embodiment of the present invention. As shown in FIG. 4, the signal detecting circuit 40 comprises: an analog voltage detecting circuit 401, configured to receive the dimming signal DIM, and to provide the analog voltage regulating enable signal EN3 based on the dimming signal DIM; and a frequency detecting circuit 402, configured to receive the dimming signal DIM, and to provide the duty cycle regulating enable signal EN1 and the amplitude regulating enable signal EN2 based on the dimming signal DIM.

In one embodiment, the analog voltage detecting circuit 401 comprises a rising edge detecting circuit or a falling edge detecting circuit. When no rising edge or no falling edge is detected in a preset time period, the analog voltage detecting circuit 401 provides a valid analog voltage regulating enable signal EN3, otherwise, the analog voltage detecting circuit 401 provides an invalid voltage regulating enable signal EN3. It should be understood that any circuit could detect if a signal is an analog signal or a pulse signal could be used with present invention.

In one embodiment, the frequency detecting circuit 402 detects the frequency of the dimming signal DIM. When the frequency of the dimming signal DIM is in the first frequency range, the duty cycle regulating enable signal EN1 is valid. When the frequency of the dimming signal DIM is in the second frequency range, the amplitude regulating enable signal EN2 is valid.

Figure 5:
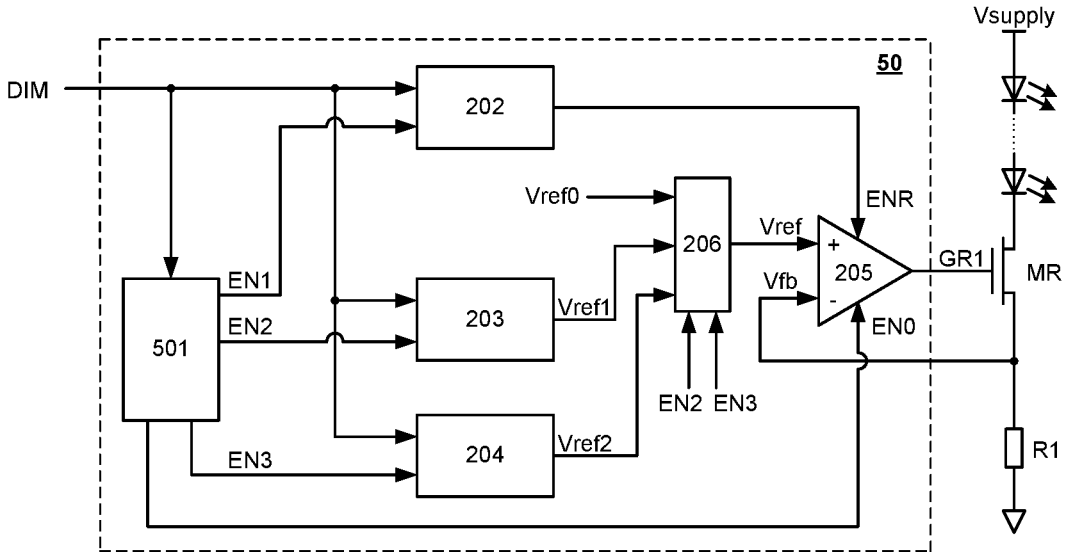
FIG. 5 schematically shows a dimming circuit 50 in accordance with an embodiment of the present invention.

FIG. 5 schematically shows a dimming circuit 50 in accordance with an embodiment of the present invention. Different from the dimming circuit 20 in FIG. 2, the dimming signal DIM provided to the dimming circuit 50 further comprises enable information. The dimming circuit 50 comprises a signal detecting circuit 501, configured to receive the dimming signal DIM, and to provide a dimming enable signal EN0, the duty cycle regulating enable signal EN1, the amplitude regulating enable signal EN2 and the analog voltage regulating enable signal EN3 based on the dimming signal DIM. In one embodiment, the signal detecting circuit 501 provides the dimming enable signal EN0 to the amplifying circuit 205 to disable the amplifying circuit 205 when the dimming signal DIM keeps a low level voltage, e.g., 0 volts, for a preset time period Tdisable. If the dimming signal DIM is detected to be an analog signal with a voltage higher than a preset value, e.g., 0 volts, then the analog voltage regulating enable signal EN3 is valid. If the dimming signal DIM is detected to be a pulse signal with a frequency in the first frequency range, the duty cycle regulating enable signal EN1 is valid. If the dimming signal DIM is detected to be a pulse signal with a frequency in the second frequency range, the amplitude regulating enable signal EN2 is valid. The rest circuit of the dimming circuit 501 is similar with the circuits in the dimming circuit 201.

In some applications, when dimming enable signal EN0 disables the amplifying circuit 205 when the dimming signal DIM is detected to be in a specific voltage form for a preset time period Tdisable.

The operation of the dimming circuit 50 is similar with the operation of the dimming circuit 20, and is not described here for brevity.

Figure 6:
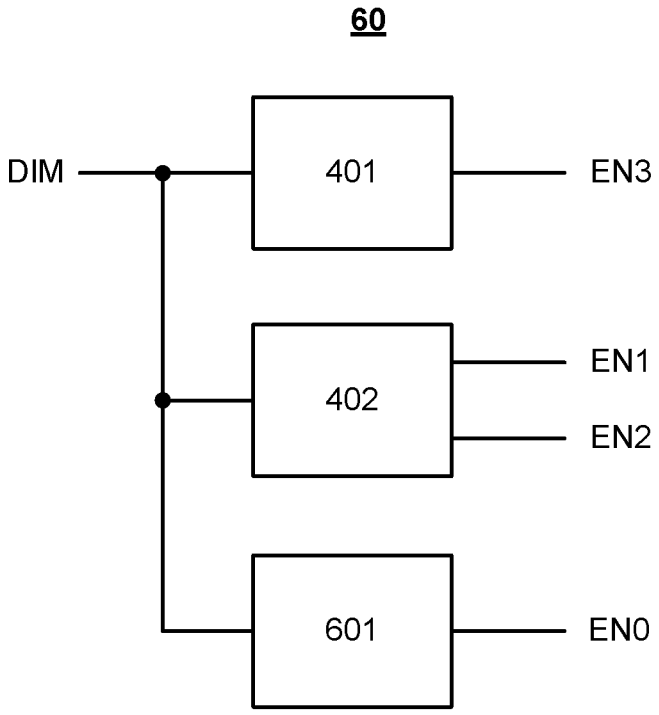
FIG. 6 schematically shows a signal detecting circuit 60 in accordance with an embodiment of the present invention.

FIG. 6 schematically shows a signal detecting circuit 60 in accordance with an embodiment of the present invention. The signal detecting circuit 60 could be adopted by the dimming circuit 50. The signal detecting circuit 60 is similar with the signal detecting circuit 40 in FIG. 4. The difference between the signal detecting circuit 60 and the signal detecting circuit 40 is that: the signal detecting circuit 60 further comprises a dimming enable circuit 601, configured to receive the dimming signal DIM, and to provide the dimming enable signal EN0 to the amplifying circuit 205, wherein when the dimming signal DIM keeps a specific voltage level for a preset time period Tdisable, the amplifying circuit 205 is disabled, otherwise, the amplifying circuit 205 works. In one embodiment, the dimming enable circuit 601 may comprise a timing circuit.

Figure 7:
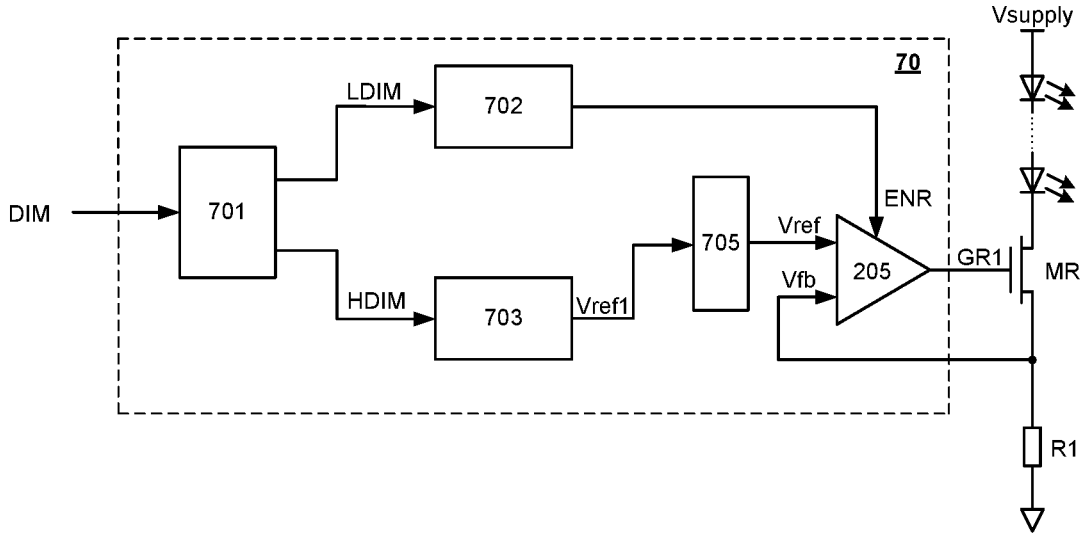
FIG. 7 schematically shows a dimming circuit 70 in accordance with an embodiment of the present invention.

FIG. 7 schematically shows a dimming circuit 70 in accordance with an embodiment of the present invention. The dimming circuit 70 comprises: a filter circuit 701, configured to receive the dimming signal DIM, and to provide a first frequency dimming signal LDIM and a second frequency dimming signal HDIM, wherein a frequency of the first frequency dimming signal LDIM is in the first frequency range, and a frequency of the second frequency dimming signal HDIM is in the second frequency range; a duty cycle regulating circuit 702, configured to receive the first frequency dimming signal LDIM, and to provide the duty cycle regulating signal ENR based on the first frequency dimming signal LDIM; an amplitude regulating circuit 703, configured to receive the second frequency dimming signal HDIM, and to provide the pulse reference signal Vref1 based on the second frequency dimming signal HDIM; a sample and hold circuit 705, configured to receive the pulse reference signal Vref1, and to provide the dimming amplitude reference signal Vref, wherein the dimming amplitude reference signal Vref is real time updated with the pulse reference signal Vref1; and the amplifying circuit 205, configured to receive the duty cycle regulating signal ENR, the dimming amplitude reference signal Vref and the feedback voltage Vfb indicating the current ILED flowing through the LED string, wherein the amplifying circuit 205 is enabled by the duty cycle regulating signal ENR, and provides the switching control signal GR1 based on an amplifying result A(GR1) of the dimming amplitude reference signal Vref and the feedback voltage Vfb.

In the example of FIG. 7, the dimming signal DIM comprises different frequency components, e.g., high frequency components and low frequency components. The filter circuit 701 divide the dimming signal DIM to the first frequency dimming signal LDIM and the second frequency dimming signal HDIM. In one embodiment, the first frequency dimming signal LDIM is converted to an enable signal of the amplifying circuit 205, i.e., the duty cycle regulating signal ENR, and the second frequency dimming signal HDIM is converted to an analog voltage signal, i.e., the pulse reference signal Vref1.

In one embodiment, the duty cycle regulating circuit 702 comprises a frequency converting circuit to convert the first frequency dimming signal LDIM to the duty cycle regulating signal ENR. In some embodiments, the duty cycle regulating circuit 702 is omitted and the first frequency dimming signal LDIM is provided as the duty cycle regulating signal ENR to the amplifying circuit 205.

In one embodiment, the amplitude regulating circuit 703 comprises a frequency-voltage converting circuit to convert the second frequency dimming signal HDIM to the pulse reference signal Vref1. The value of the pulse reference signal Vref1 is in proportional to the frequency of the second frequency dimming signal HDIM.

In one embodiment, the dimming signal DIM provided to the dimming circuit 70 may comprise dimming enable information. In one embodiment, the dimming circuit 70 further comprises the dimming enable circuit 601 in FIG. 6, configured to receive the dimming signal DIM, and provides the dimming enable signal EN0 to the amplifying circuit 205, wherein when the dimming signal DIM keeps a specific voltage level for a preset time period Tdisable, the amplifying circuit 205 is disabled, otherwise, the amplifying circuit 205 works.

Figure 8:
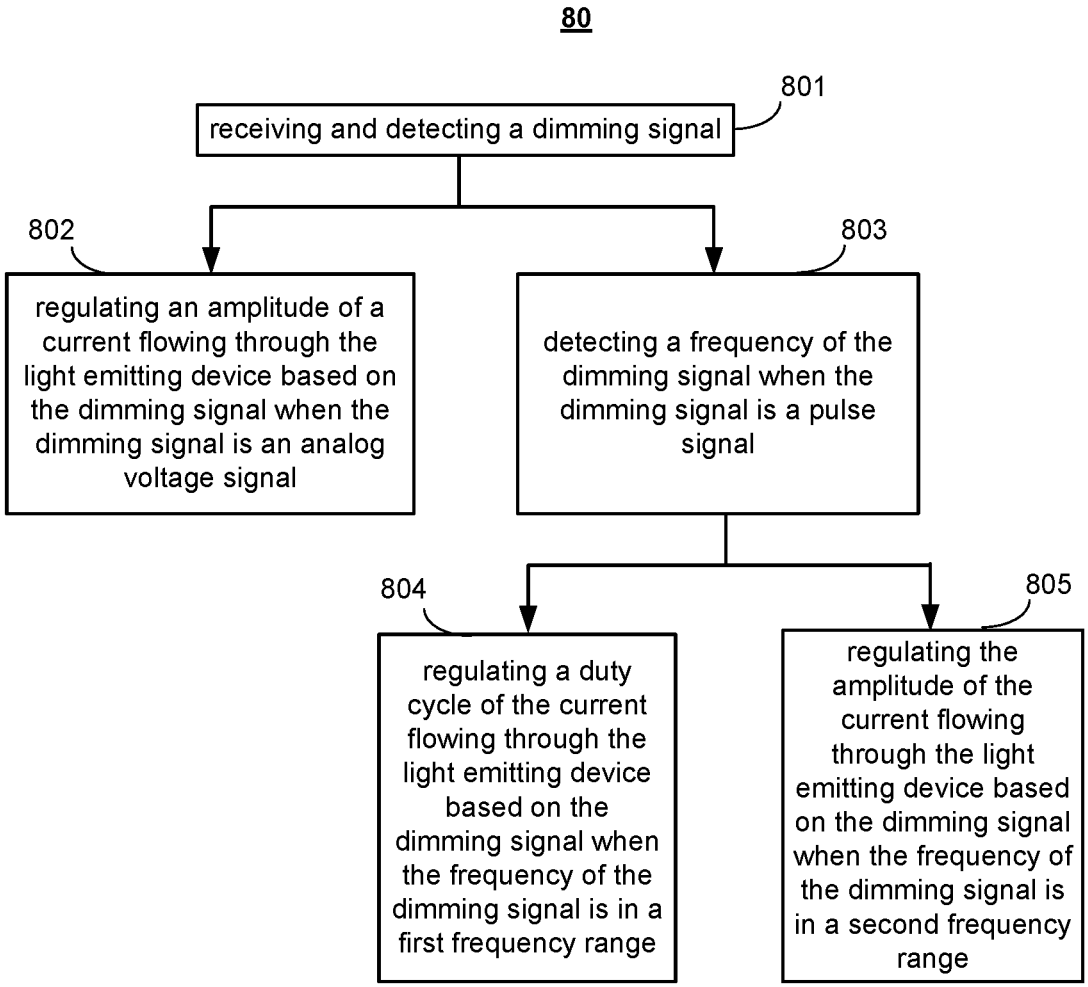
FIG. 8 shows steps of a control method 80 of a dimming circuit in accordance with an embodiment of the present invention.

FIG. 8 shows steps of a control method 80 of a dimming circuit in accordance with an embodiment of the present invention. The dimming circuit could be adopted to control a dimming switch coupled in series with the light emitting device. The control method 80 comprises:

Step 801, receiving and detecting a dimming signal DIM;

Step 802, regulating an amplitude of a current flowing through the light emitting device based on the dimming signal DIM if the dimming signal DIM is an analog voltage signal;

Step 803, detecting a frequency of the dimming signal DIM if the dimming signal DIM is a pulse signal;

Step 804, regulating a duty cycle of the current flowing through the light emitting device based on the dimming signal DIM if the frequency of the dimming signal DIM is in a first frequency range; and Step 805, regulating the amplitude of the current flowing through the light emitting device based on the dimming signal DIM if the frequency of the dimming signal DIM is in a second frequency range.

Wherein, regulating the amplitude of the current flowing through the light emitting device based on the dimming signal DIM comprises: converting the dimming signal DIM to a dimming amplitude reference signal; generating a switching control signal based on amplifying a difference between the dimming amplitude reference signal and a feedback signal indicating the current flowing through the light emitting device; and controlling the dimming switch based on the switching control signal.

In one embodiment, regulating the amplitude of the current flowing through the light emitting device further comprises: maintaining the duty cycle of the current flowing through the light emitting device be 100%.

In one embodiment, regulating the duty cycle of the current flowing through the light emitting device based on the dimming signal DIM comprises: enabling and disabling alternatively an amplifying circuit configured to amplify a difference between the dimming amplitude reference signal and a feedback signal indicating the current flowing through the light emitting device, based on the dimming signal DIM.

In one embodiment, regulating the duty cycle of the current flowing through the light emitting device based on the dimming signal DIM further comprises: maintaining the amplitude of the current flowing through the light emitting device be a preset constant value.

In one embodiment, a maximum frequency in the first frequency range is lower than a minimum frequency in the second frequency range.

In one embodiment, the control method 80 further comprises: disabling the dimming circuit when a value of the dimming signal DIM keeps a specific signal form for a preset time period Tdisable.

Obviously many modifications and variations of the present invention are possible in light of the above teachings. It is therefore to be understood that within the scope of the appended claims the invention may be practiced otherwise than as specifically described. It should be understood, of course, the foregoing disclosure relates only to a preferred embodiment (or embodiments) of the invention and that numerous modifications may be made therein without departing from the spirit and the scope of the invention as set forth in the appended claims. Various modifications are contemplated and they obviously would be resorted to by those skilled in the art without departing from the spirit and the scope of the invention as hereinafter defined by the appended claims as only a preferred embodiment(s) thereof has been disclosed.

What is claimed is:

1. A dimming circuit for dimming a current flowing through a light emitting device, comprising:

a multi-function pin, configured to receive a dimming signal; wherein when the dimming signal is an analog voltage signal, an amplitude of the current flowing through the light emitting device is regulated based on the dimming signal;

when the dimming signal is a pulse signal and a frequency of the dimming signal is in a first frequency range, a duty cycle of the current flowing through the light emitting device is regulated based on the dimming signal; and when the dimming signal is the pulse signal and the frequency of the dimming signal is in a second frequency range, the amplitude of the current flowing through the light emitting device is regulated based on the dimming signal.

2. The dimming circuit of claim 1, further comprising:

a signal detecting circuit, configured to receive the dimming signal, and to provide a duty cycle regulating enable signal, an amplitude regulating enable signal and an analog voltage regulating enable signal based on the dimming signal;

a duty cycle regulating circuit, configured to receive the diming signal and the duty cycle regulating enable signal, and to provide a duty cycle regulating signal based on the dimming signal and the duty cycle regulating enable signal;

an amplitude regulating circuit, configured to receive the dimming signal and the amplitude regulating enable signal, and to provide a pulse reference signal based on the dimming signal and the amplitude regulating enable signal;

an analog regulating circuit, configured to receive the dimming signal and the analog voltage regulating enable signal, and to provide an analog reference signal based on the dimming signal and the analog voltage regulating enable signal; and an amplifying circuit, configured to receive the duty cycle regulating signal, a dimming amplitude reference signal and a feedback voltage indicating the current flowing through the light emitting device, wherein the amplifying circuit is enabled by the duty cycle regulating signal, and provides a switching control signal based on an amplifying result of the dimming amplitude reference signal and the feedback voltage, wherein the dimming amplitude reference signal is one of a default reference signal, the pulse reference signal and the analog reference signal.

3. The dimming circuit of claim 2, further comprising:

a selecting circuit, configured to receive the default reference signal, the pulse reference signal, the analog reference signal, the amplitude regulating enable signal and the analog voltage regulating enable signal, wherein the pulse reference signal is selected by the selecting circuit as the dimming amplitude reference signal when the amplitude regulating enable signal is valid;

the analog reference signal is selected by the selecting circuit as the dimming amplitude reference signal when the analog voltage regulating enable signal is valid; and the default reference signal is selected by the selecting circuit as the dimming amplitude reference signal when neither of the amplitude regulating enable signal and the analog voltage regulating enable signal is valid.

4. The dimming circuit of claim 2, wherein the signal detecting circuit comprises:

an analog voltage detecting circuit, configured to receive the dimming signal, and to provide the analog voltage regulating enable signal based on the dimming signal; and a frequency detecting circuit, configured to receive the dimming signal, and to provide the duty cycle regulating enable signal and the amplitude regulating enable signal based on the dimming signal.

5. The dimming circuit of claim 2, wherein the signal detecting circuit comprises:

a dimming enable circuit, configured to receive the dimming signal, and to provide the dimming enable signal to the amplifying circuit, wherein the amplifying circuit is disabled when the dimming signal is detected to be in a specific signal form for a preset time period;

an analog voltage detecting circuit, configured to receive the dimming signal, and to provide the analog voltage regulating enable signal based on the dimming signal; and a frequency detecting circuit, configured to receive the dimming signal, and to provide the duty cycle regulating enable signal and the amplitude regulating enable signal based on the dimming signal.

6. The dimming circuit of claim 2, further comprising a dimming switch coupled in series with the light emitting device, wherein the dimming switch is controlled by the switching control signal.

7. The dimming circuit of claim 2, further comprises a feedback resistor, coupled in series with the light emitting device, wherein the current flowing through the light emitting device flows through the feedback resistor to generate the feedback voltage across the feedback resistor.

8. The dimming circuit of claim 1, further comprising:

a filter circuit, configured to receive the dimming signal, and to provide a first frequency dimming signal and a second frequency dimming signal, wherein a frequency of the first frequency dimming signal is in the first frequency range, and a frequency of the second frequency dimming signal is in the second frequency range;

a duty cycle regulating circuit, configured to receive the first frequency dimming signal, and to provide a duty cycle regulating signal based on the first frequency dimming signal;

an amplitude regulating circuit, configured to receive the second frequency dimming signal, and to provide a pulse reference signal based on the second frequency dimming signal;

a sample and hold circuit, configured to receive the pulse reference signal, and to provide a dimming amplitude reference signal; and an amplifying circuit, configured to receive the duty cycle regulating signal, the dimming amplitude reference signal and a feedback voltage indicating the current flowing through the light emitting device, wherein the amplifying circuit is enabled by the duty cycle regulating signal, and provides a switching control signal based on an amplifying result of the dimming amplitude reference signal and the feedback voltage.

9. The dimming circuit of claim 8, further comprising:

a dimming enable circuit, configured to receive the dimming signal, and to provide the dimming enable signal to the amplifying circuit, wherein the amplifying circuit is disabled when the dimming signal is detected to be in a specific signal form for a preset time period.

10. A control method of a dimming circuit adopted to control a dimming switch coupled in series with a light emitting device, comprising:

receiving and detecting a dimming signal;

regulating an amplitude of a current flowing through the light emitting device based on the dimming signal when the dimming signal is an analog voltage signal;

detecting a frequency of the dimming signal when the dimming signal is a pulse signal;

regulating a duty cycle of the current flowing through the light emitting device based on the dimming signal when the frequency of the dimming signal is in a first frequency range; and regulating the amplitude of the current flowing through the light emitting device based on the dimming signal when the frequency of the dimming signal is in a second frequency range.

11. The control method of claim 10, wherein regulating the amplitude of the current flowing through the light emitting device based on the dimming signal comprises:

converting the dimming signal to a dimming amplitude reference signal;

generating a switching control signal based on amplifying a difference between the dimming amplitude reference signal and a feedback signal indicating the current flowing through the light emitting device; and controlling the dimming switch based on the switching control signal.

12. The control method of claim 10, wherein regulating the amplitude of the current flowing through the light emitting device based on the diming signal comprises maintaining the duty cycle of the current flowing through the light emitting device be 100%.

13. The control method of claim 10, wherein regulating the duty cycle of the current flowing through the light emitting device based on the dimming signal comprises:

generating a switching control signal based on amplifying a difference between a default reference signal and a feedback signal indicating the current flowing through the light emitting device;

enabling and disabling alternately an amplifying circuit configured to amplify the difference between the default reference signal and the feedback signal; and controlling the dimming switch based on the switching control signal.

14. The control method of claim 13, wherein regulating the duty cycle of the current flowing through the light emitting device based on the dimming signal comprises:

maintaining the amplitude of the current flowing through the light emitting device be a preset constant value.

15. The control method of claim 10, wherein regulating the duty cycle of the current flowing through the light emitting device based on the dimming signal further comprises: disabling the dimming circuit when a value of the dimming signal is detected to be in a specific signal form for a preset time period.

16. The control method of claim 10, wherein an upper limit of the first frequency range is lower than a lower limit of the second frequency range.

17. A control method of a dimming circuit adopted to control a dimming switch coupled in series with a light emitting device, comprising:

receiving a dimming signal;

dividing the dimming signal into a first frequency dimming signal and a second frequency dimming signal;

regulating a duty cycle of the current flowing through the light emitting device based on the first frequency dimming signal; and regulating an amplitude of the current flowing through the light emitting device based on the second frequency dimming signal.

18. The control method of claim 17, wherein the first frequency dimming signal has a higher frequency than the second frequency dimming signal.

19. The control method of claim 17, wherein the first frequency dimming signal has a lower frequency than the second frequency dimming signal.

* * * * *